US007195232B2

(12) United States Patent
Marshall et al.

(10) Patent No.: US 7,195,232 B2
(45) **Date of Patent: *Mar. 27, 2007**

(54) HANDRAIL AND BRACKET ASSEMBLY

(75) Inventors: Michael B Marshall, Elkhart, IN (US); Jason J Newburn, Elkhart, IN (US)

(73) Assignee: Marson International LLC, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/996,014

(22) Filed: Nov. 23, 2004

(65) Prior Publication Data

US 2005/0067610 A1 Mar. 31, 2005

Related U.S. Application Data

(63) Continuation of application No. 10/283,533, filed on Oct. 30, 2002, now Pat. No. 6,843,468.

(60) Provisional application No. 60/390,143, filed on Jun. 20, 2002.

(51) Int. Cl.
*B60R 27/00* (2006.01)
*E04F 11/18* (2006.01)

(52) U.S. Cl. ..... 256/65.16; 16/438; 16/900; 248/274.1

(58) Field of Classification Search ..... 256/1, 256/65.03, 65.04, 65.1, 5, 67, 403, 65.16; 403/93, 94, 96; 248/291.1, 274, 205.1, 274.1; 16/438, 900
See application file for complete search history.

(56) References Cited

U.S. PATENT DOCUMENTS 1,179,286 A * 4/1916 Crimmel ..... 248/289.11
1,435,110 A 11/1922 Efford
1,796,344 A 3/1931 Pleiss
2,411,448 A 11/1946 McLean
2,437,647 A 3/1948 McLean
2,796,268 A * 6/1957 Larson ..... 403/94
3,329,385 A * 7/1967 Dietsch ..... 248/290.1
3,529,850 A * 9/1970 Montalto ..... 403/94
3,675,785 A * 7/1972 Martin ..... 280/769
3,847,336 A * 11/1974 Morris et al. ..... 403/94
3,929,228 A 12/1975 Margolin et al.
4,029,352 A 6/1977 Evans
4,131,259 A * 12/1978 Franks ..... 211/75
4,261,550 A 4/1981 Gregory
4,335,862 A * 6/1982 Sherman ..... 248/289.11
4,720,116 A 1/1988 Williams et al.

(Continued)

OTHER PUBLICATIONS

"Lend-A-Hand: Installation Instructions", Stomberg Carlson Products, Inc., Apr. 11, 1996, 2 pages.*

*Primary Examiner*—Daniel P. Stodola
*Assistant Examiner*—Ernesto Garcia
(74) *Attorney, Agent, or Firm*—Baker & Daniels LLP

(57) ABSTRACT

A handrail and bracket assembly includes a pair of brackets having two off-set channels that permit the hand rail to be positioned in an expanded or in-use position or a collapsed or stowed position. At least one mounting opening is provided in each bracket for securing it to a wall or other surface. The channels and openings are positioned such that the brackets can be attached to the handrail prior to attaching the brackets to a wall or other surface.

2 Claims, 10 Drawing Sheets

U.S. PATENT DOCUMENTS 4,823,910 A 4/1989 Day
4,976,455 A * 12/1990 Brammer et al. ..... 403/94
5,024,420 A 6/1991 Downing
5,028,029 A 7/1991 Beck et al.
5,078,276 A * 1/1992 Rogge et al. ..... 248/289.11
6,308,843 B1 * 10/2001 De Boer ..... 211/104
6,375,146 B1 4/2002 Painchaud
6,464,189 B1 * 10/2002 Yu ..... 248/323
6,843,468 B2 * 1/2005 Marshall et al. ..... 256/65.16
6,974,134 B1 * 12/2005 Macri et al. ..... 16/412
2006/0085948 A1 * 4/2006 Brammer et al. ..... 16/412

* cited by examiner

HANDRAIL AND BRACKET ASSEMBLY

This is a continuation of U.S. patent application Ser. No. 10/283,533, filed Oct. 30, 2002, which is based on U.S. Provisional Patent Application Ser. No. 60/390,143, filed Jun. 20, 2002, the complete disclosures of which are hereby expressly incorporated by reference.

BACKGROUND AND SUMMARY OF THE INVENTION

Field of the Invention

The present invention relates to a handrail and bracket assembly, and, in particular, to a handrail and bracket assembly that permits the rail to be selectively retained in two different positions.

The present invention relates to a handrail and bracket assembly, and, in particular, to a handrail and bracket assembly that permits the rail to be selectively retained in two different positions.

Handrails of various kinds are known and used in a number of environments. Well-known examples include the use of handrails along stairs and in or near showers or bathtubs. Handrails have also been used in vehicles. For example, handrails have been used near the entrance to recreational vehicles to assist in entering and exiting the vehicle. For example, U.S. Pat. No. 4,976,455 shows the use of a handrail near the entry door to a recreational vehicle. The handrail is located outside the vehicle and can be collapsed, which is typically done while the vehicle is in motion.

The present invention provides a handrail and bracket assembly that permits the rail to be selectively retained in two different positions. The rail can be used in any environment where it is desirable to provide a handrail, such as inside or outside recreational vehicles, near showers and bathtubs, etc.

In one embodiment of the present invention, a handrail and bracket assembly includes a rail and a bracket. The bracket includes a base, first and second walls extending from the base, at least one mounting hole in the base and a channel for receiving the rail. The mounting hole is located nearer one of the walls than the other wall and the axis of the channel is located nearer one of the walls than the other wall. In one embodiment, the mounting hole is located nearer the first wall than the second wall and the axis of the channel is located nearer the second wall than the first wall. In another embodiment, the axis is the central, longitudinal axis of the channel. The mounting hole and a portion of the channel may be located between the first and second walls.

In another embodiment of the invention, the bracket includes a second channel for receiving the rail. The central, longitudinal axis of the second channel may be perpendicular to the central longitudinal axis of the first channel.

In another embodiment of the invention, a handrail and bracket assembly includes a rail and a bracket. The bracket includes a base, a first wall extending from the base and a second wall extending from the base, the second wall being parallel to the first wall. At least one mounting hole is located in the base between the first and second walls. The mounting hole is located nearer the first wall than the second wall. The bracket further includes a first channel for retaining the rail in a first position and a second channel for retaining the rail in a second position. The first channel has a central, longitudinal axis located between the first and second walls and nearer the second wall than the first wall.

The second channel has a central, longitudinal axis perpendicular to the central, longitudinal axis of the first channel. The assembly may further include a fastener for securing the rail to the bracket and an opening in the first channel for receiving the fastener. The opening may be located along the central, longitudinal axis of the first or second channel.

In another embodiment of the invention, the assembly further includes a spring for biasing the rail toward the first channel when the rail is retained in the first position and toward the second channel when the rail is retained in the second position. The fastener may extend through the spring. The spring may be located between the first and second walls.

In another embodiment of the invention, a handrail and bracket assembly includes a rail and a bracket. The bracket includes a base and first and second walls extending from the base and perpendicular to it. The assembly further includes first means for retaining the rail in a first position between the first and second walls such that the rail extends parallel to the first and second walls and is located nearer the first wall than the second wall and second means for retaining the rail in a second position such that the rail extends perpendicular to the first and second walls. The bracket further includes at least one mounting hole in the base. The mounting hole is located nearer the second wall than the first wall. In one embodiment, the first means includes a channel. The first means can also include a fastener and a spring. The second means may also include a channel, a fastener and a spring.

In another embodiment, the assembly includes means for biasing the rail into the channel when the rail is in the first position. The means may include a spring. The spring may be located between the first and second walls.

Other features of the present invention will be apparent to those of skill in the art from the following detailed description of the embodiments and the accompanying drawings.

DETAILED DESCRIPTION OF EMBODIMENTS OF THE INVENTION

Figure 1:
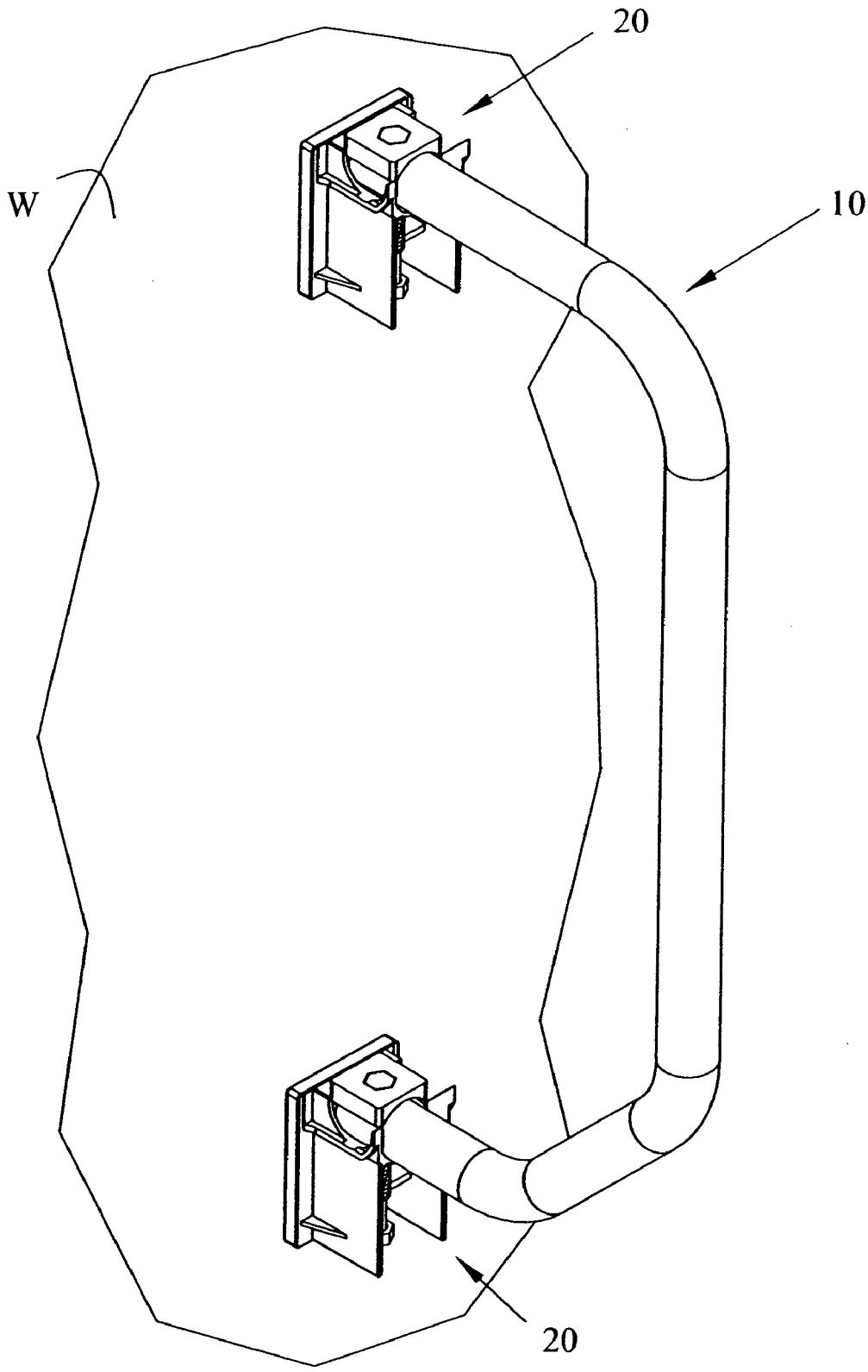
FIG. 1 is a perspective view of a handrail and bracket assembly according to one embodiment of the present invention shown attached to a wall.

FIG. 1 is a perspective view of a handrail and bracket assembly according to one embodiment of the present invention. The handrail and bracket assembly is shown attached to a wall W. The handrail and bracket assembly of this embodiment generally includes a rail 10 and a pair of brackets 20. Rail 10, in the embodiment shown, is a tubular member of generally circular cross-section. Rail 10 may be formed in any shape desired for the particular application. Additionally, the cross-section of rail 10 need not be circular, but can take on any number of shapes desired. Rail 10 should be manufactured from a material suitable to withstand the load conditions for its intended use. For example, depending on the environment, rail 10 can be made of stainless steel, aluminum, plastic, or other materials.

Figure 2:
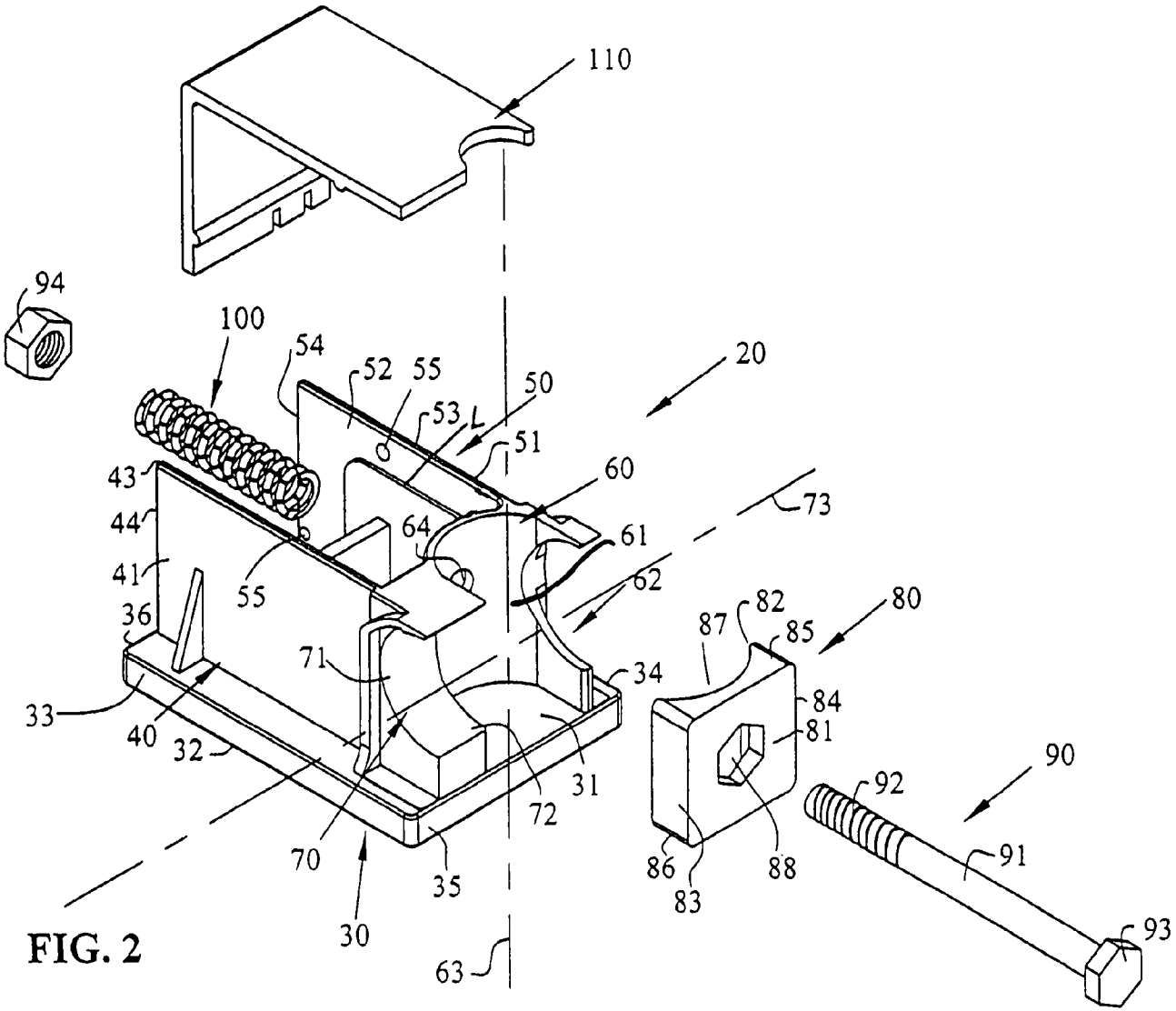
FIG. 2 is an exploded, perspective view of a bracket that forms a component of the handrail and bracket assembly shown in FIG. 1.
Figure 3:
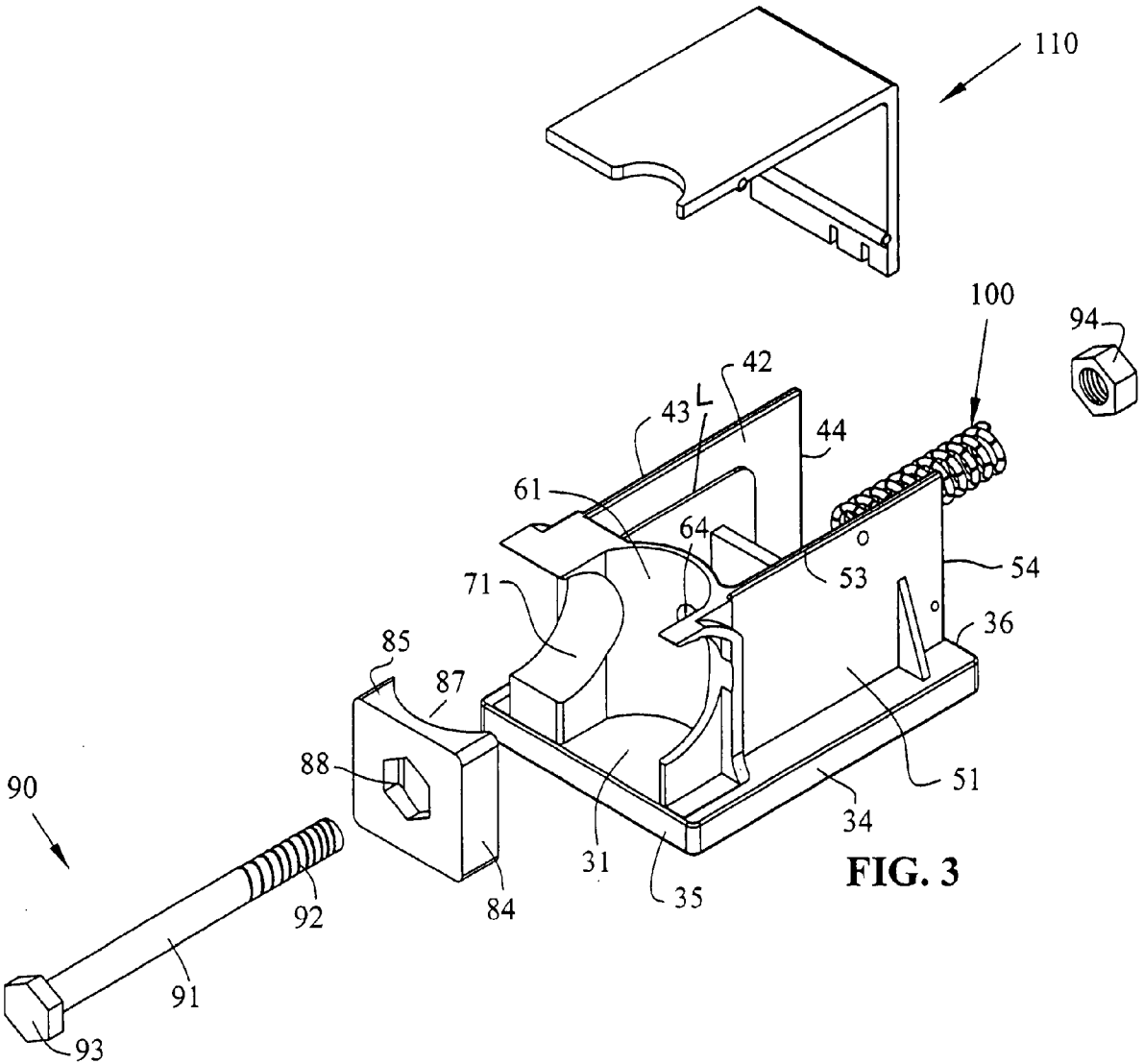
FIG. 3 is an exploded, perspective view of the opposite side of the bracket of FIG. 2.
Figure 4:
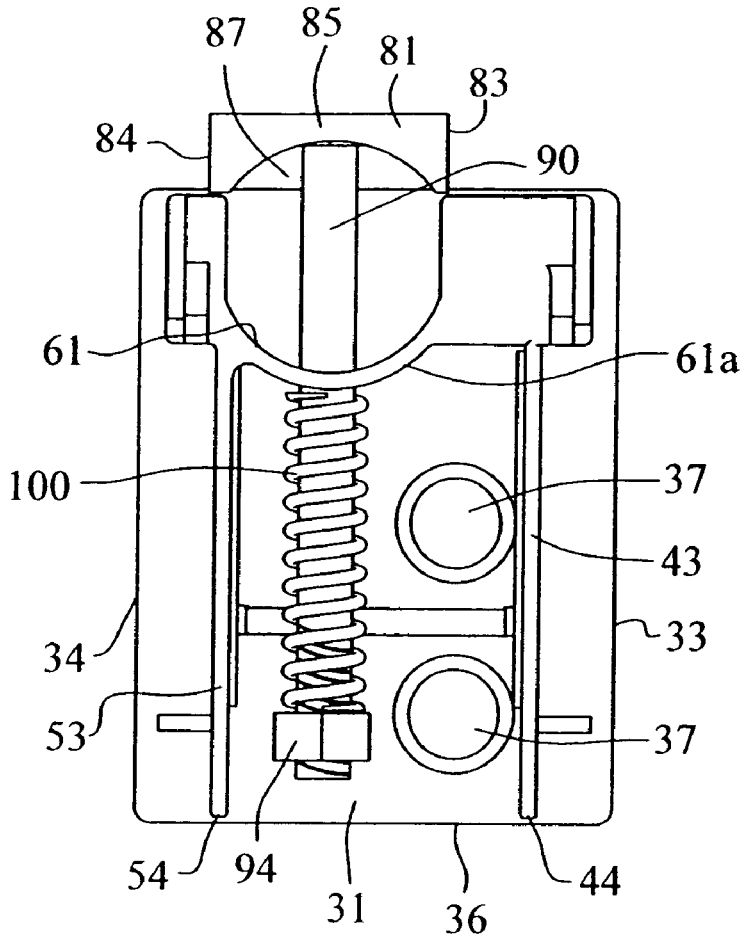
FIG. 4 is a front elevational view of the bracket of FIG. 2 with the cover removed.

Each bracket 20 (FIGS. 2 and 3) generally includes a base 30, a first wall 40, a second wall 50, a first channel 60, a second channel 70, a cap 80, a fastener 90, a biasing means 100 and a cover 110. Base 30, in the embodiment shown, is a generally rectangular member including a first or front surface 31, a second or rear surface 32, a first edge 33, a second edge 34, a third edge 35 and a fourth edge 36. In the embodiment shown, a pair of mounting holes 37 extend through first surface 31 and second surface 32 (FIG. 4). Note that mounting holes 37 are located nearer first wall 40 than second wall 50.

First wall 40 extends from first surface 31 of base 30 and is generally perpendicular thereto. First wall 40 includes a first or exterior surface 41, a second or interior surface 42, a first or front edge 43 and a second edge 44.

Similarly, second wall 50 includes a first or exterior surface 51, a second or interior surface 52, a first or front edge 53 and a second edge 54. Second wall 50 further includes a pair of holes 55 for attaching cover 110, as described below. Second wall 50 also extends from and is generally perpendicular to first surface 31 of base 30.

First channel 60 extends between first wall 40 and second wall 50 and includes a lower surface 61, an underside 61A, an open top 62 and a central longitudinal axis 63. Axis 63 is perpendicular to first surface 31 of base 30 and parallel to second surface 42 of first wall 40 and second surface 52 of second wall 50. Note that first channel 60 is located such that axis 63 is located nearer second wall 50 than first wall 40. Channel 60 is configured to receive rail 10, as described below.

Second channel 70 includes a lower surface 71 and an open top 72. Second channel 70 further includes a central longitudinal axis 73. Axis 73 is located nearer front edges 43 and 53 of first wall 40 and second wall 50 than it is near first surface 31 of base 30. Axis 73 extends perpendicular to axis 63 of first channel 60. Channel 70 is configured to receive rail W, as described below.

Figure 5:
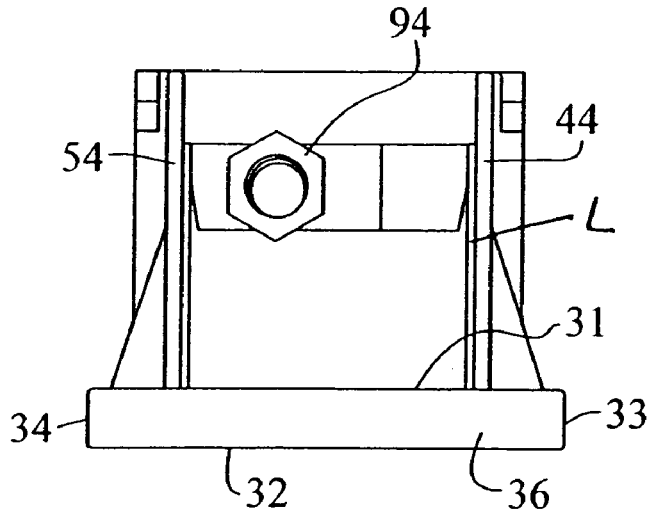
FIG. 5 is a bottom plan view of the bracket of FIG. 2 with the cover removed.
Figure 6:
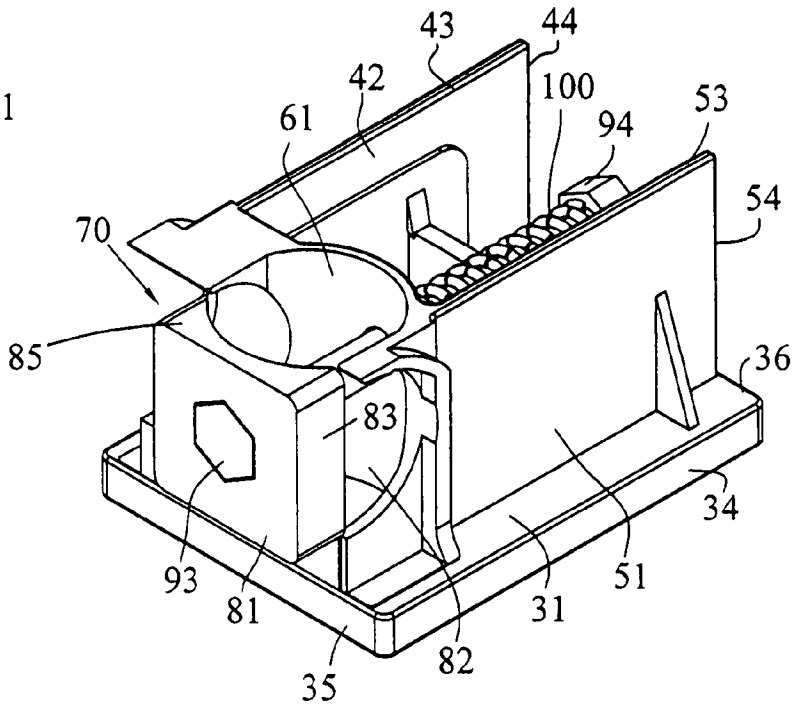
FIG. 6 is a perspective view of the assembled bracket of FIG. 2, with the cover removed.
Figure 7:
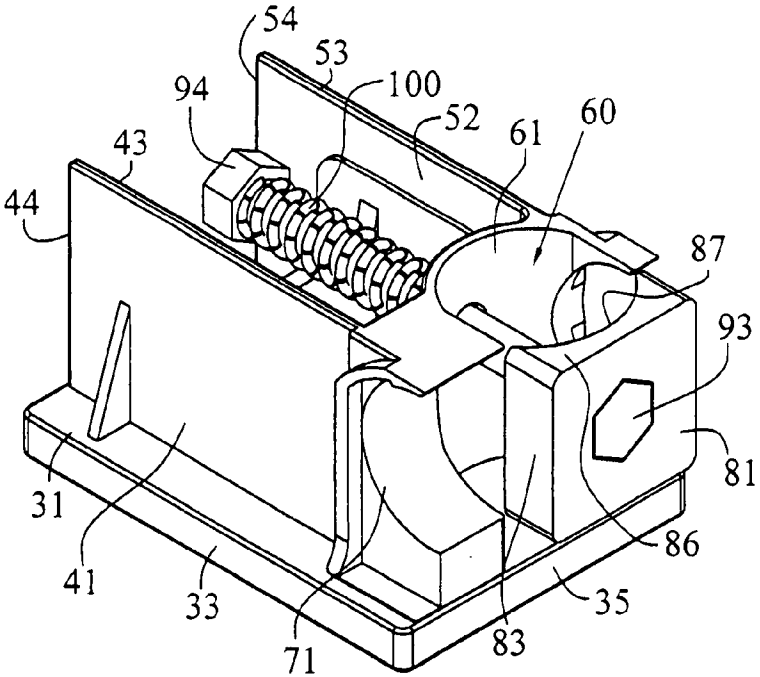
FIG. 7 is a perspective view of the opposite side of assembled bracket as shown in FIG. 6.
Figure 8:
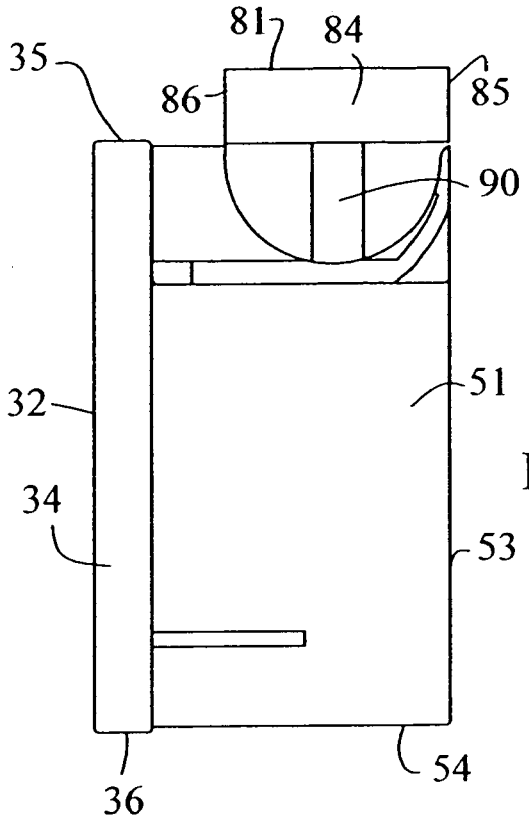
FIG. 8, is a side, elevational view of the bracket of FIG. 2, with the cover removed.
Figure 9:
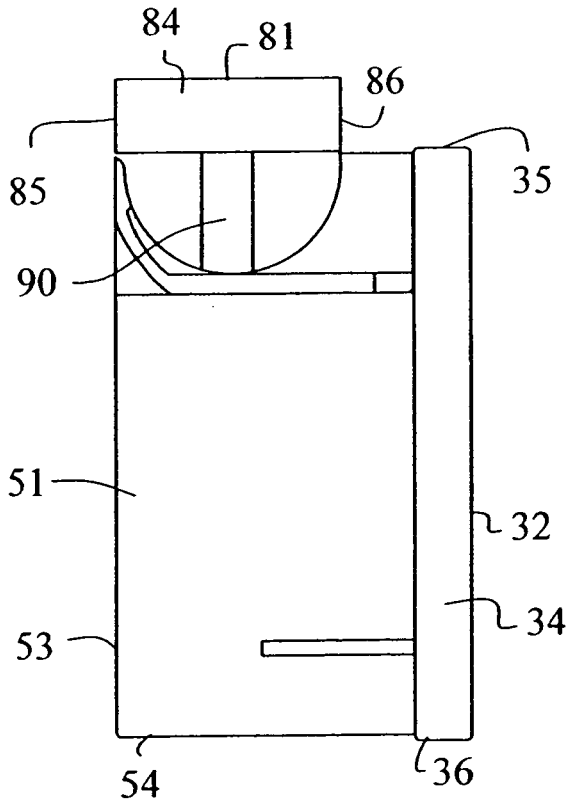
FIG. 9 is a side, elevational view of the opposite side the bracket as shown in FIG. 8.

Referring to FIGS. 4 and 5, bracket 20 includes a lip L extending around the interior of bracket 20 along surfaces 31, 41, 51 and underside 61A of channel 60 as shown. As described below, lip L limits the movement of cover 110 and positions it for attachment to second wall 50.

Bracket 20 further includes a cap 80 that engages rail 10 as described below. Cap 80 includes a first or top surface 81, a second or bottom surface 82, a first edge 83, a second edge 84, a third edge 85 and a fourth edge 86. A recess 87, which conforms to the outer surface of rail 10, is formed in bottom surface 82 and extends from third edge 85 to fourth edge 86. An opening 88 extends through first surface 81 and second surface 82 of cap 80.

Fastener 90, in the embodiment shown, is a bolt that includes a shaft with a first portion 91 and a second, threaded portion 92. Fastener 90 further includes a head 93 and a nut 94. Head 93 is shaped to mate with opening 88, as described below. Biasing means 100, in the embodiment shown, is a coil spring. Spring 100 is placed around the shaft of fastener 90 as described below.

Cover 110 is a generally L-shaped member including a first leg 111 and a second leg 112. A recess 113 is formed in second leg 112 and corresponds to the shape of first channel 60. A pair of bosses 114 are formed, respectively, on first leg 111 and second leg 112. Bosses 114 include openings 115 extending as shown. Cover 110 fits between first wall 40 and second wall 50, as described below.

To assemble the rail 10 and bracket 20, one end of rail 10 is placed in channel 60 such that an opening (not shown) extending through rail 10 is aligned with opening 64 in channel 60. Cap 80 is then placed on rail 10 such that rail 10 rests within recess 87. Fastener 90 is then inserted through opening 88 in cap 80, the opening in rail 10, and opening 64 such that shaft 91 including threaded portion 92 extends between first wall 40 and second wall 50. Biasing means 100 is then placed around fastener 90 and nut 94 is threaded onto portion 92 to retain biasing means 100 in place and to retain bracket 20 on rail 10. A second bracket 20 is attached to the opposite end of rail 10 in the same manner.

Once brackets 20 have been secured to rail 10, the combined handrail and bracket assembly may be mounted to wall W. To do so, the brackets are positioned in the desired location and screws or other fasteners are inserted through openings 37 in base 30 to secure brackets 20 and rail 10 to wall W. Note that because channel 60 is offset so as to be closer to second wall 50 than first wall 41 and openings 37 are offset so as to be closer to first wall 40 than second wall 50, brackets 20 may be assembled to rail 10 before being attached to wall W. If both channel 60 and openings 37 were centered with respect to walls 40 and 50, brackets 20 would have to be attached to wall W before rail 10 could be attached to brackets 20. Otherwise, fastener 90 and biasing means 100 would block access to openings 37.

Once rail 10 and brackets 20 have been secured to wall W, cover 110 is secured to each bracket 20. This is accomplished by inserting cover 110 between walls 40 and 50 until it engages lip L. In this position, openings 55 in second wall 50 are aligned with openings 115 in cover 110. Screws or other fasteners are then inserted through openings 55 and 115 to secure cover 110 in place.

Figure 10:
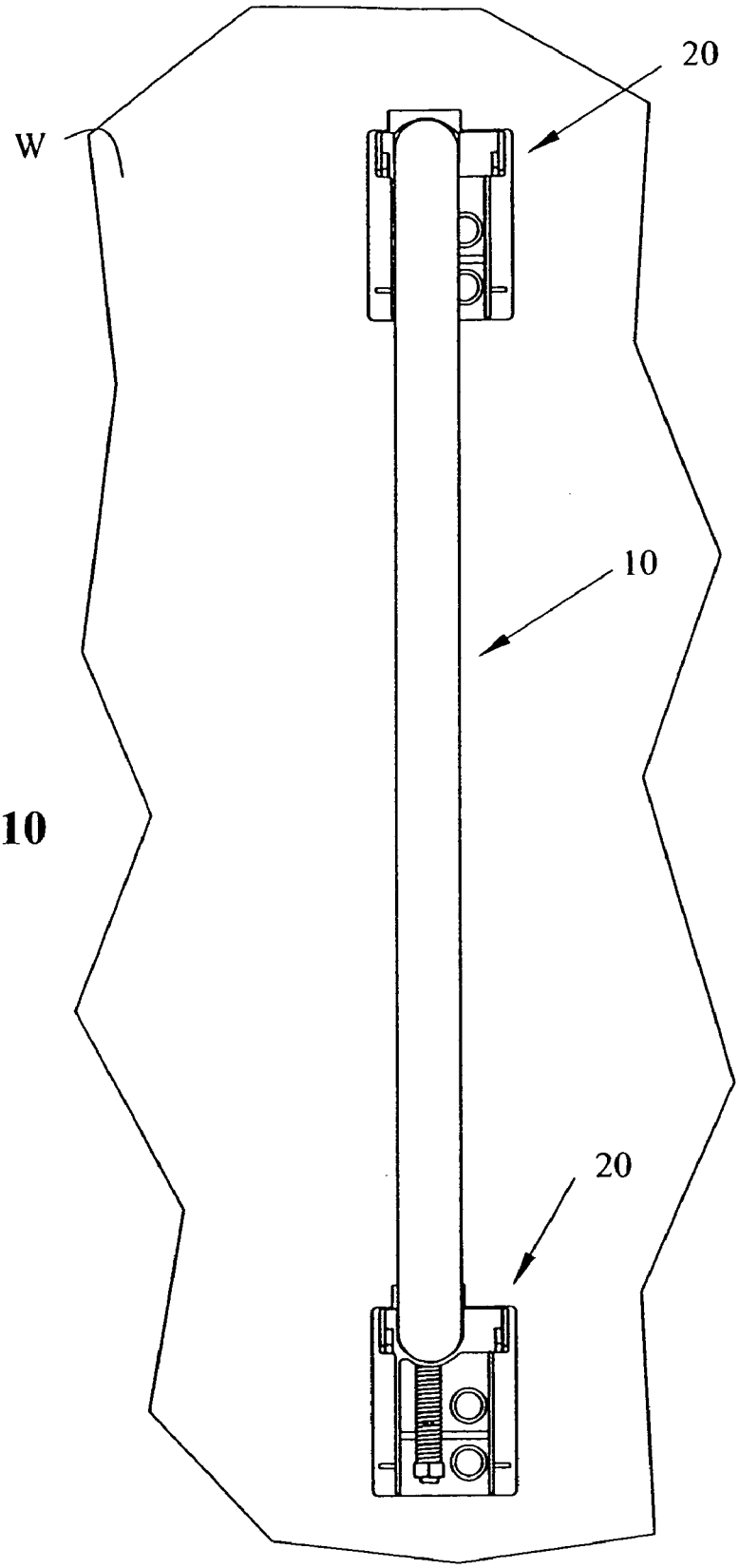
FIG. 10 is an elevational view taken perpendicular to wall W in FIG. 1.
Figure 11:
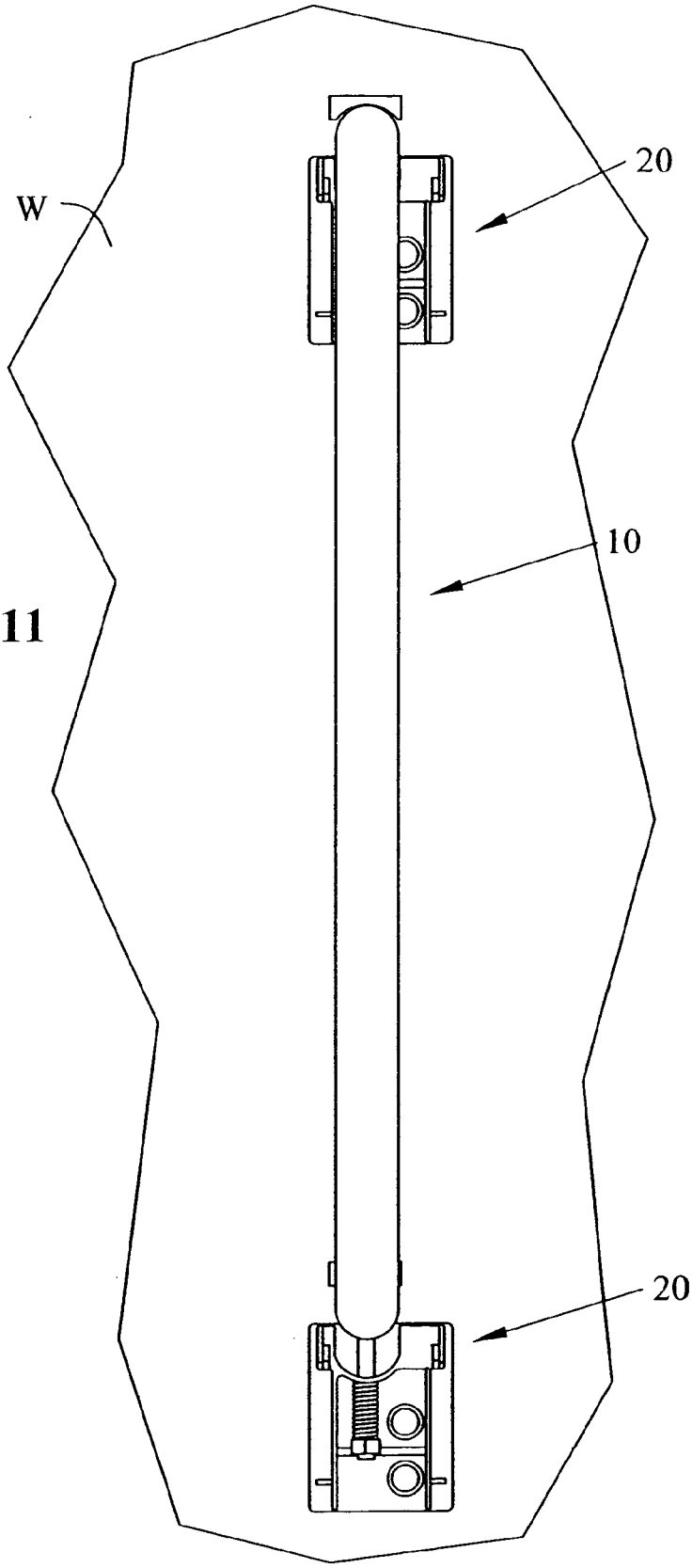
FIG. 11 shows the same view as FIG. 10 with the handrail raised for movement.
Figure 12:
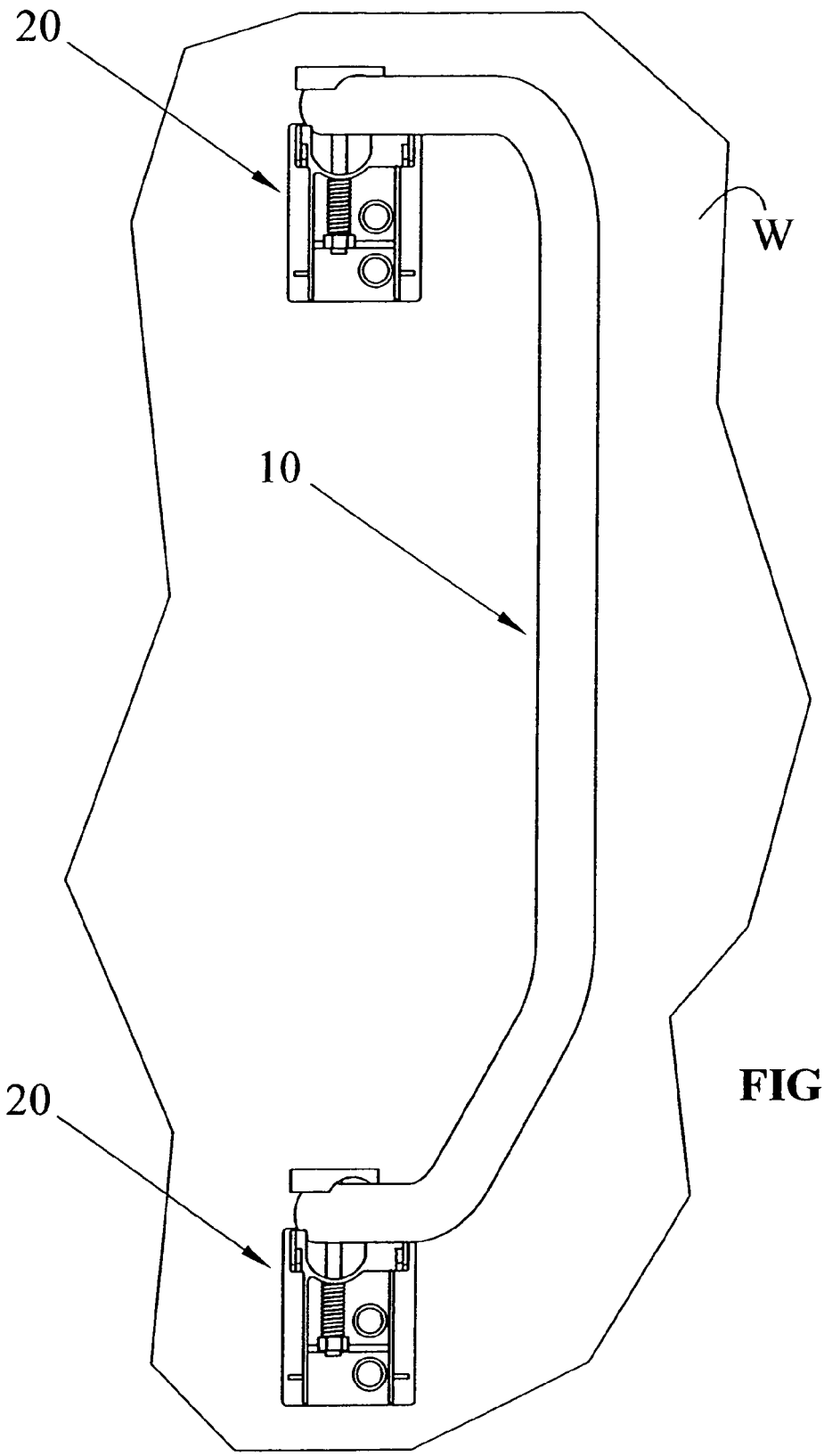
FIG. 12 shows the handrail partially rotated.
Figure 13:
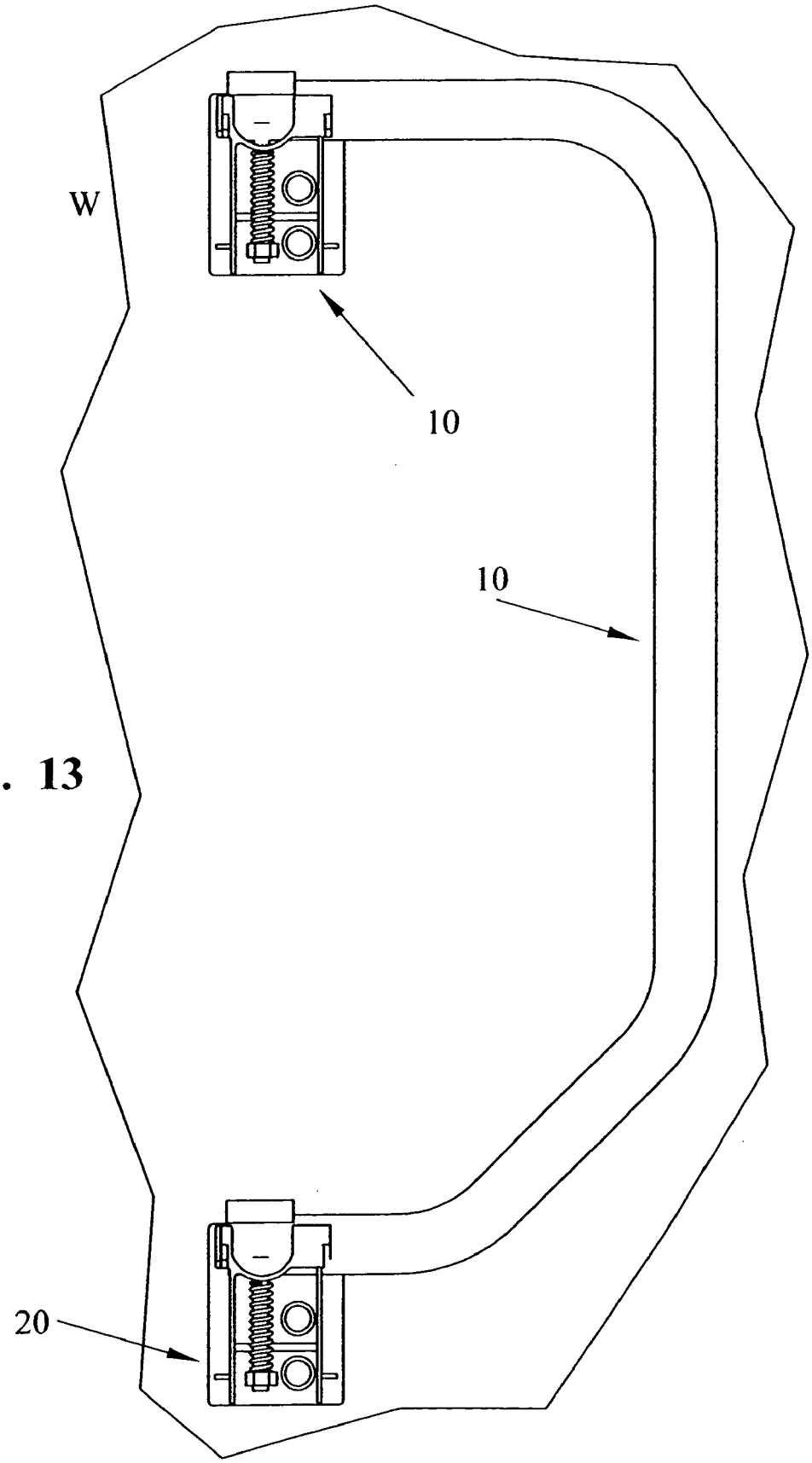
FIG. 13 shows the hand rail in the collapsed or stowed position.

FIGS. 10–13 show the movement of rail 10 from an expanded or in-use position to a collapsed or stored position. FIG. 10 shows a front elevational view of rail 10 and brackets 20 attached to wall W with rail 10 in the expanded or in-use position. In this position, rail 10 rests against lower surface 61 of each channel 60. Biasing means 100 extends between the underside 61A of each channel 60 and nut 94. Note that in this position, biasing means 100 biases rail 10 into channel 60 by exerting a force between undersurface 61A and nut 94. This urges nut 94 downwardly which in turn pulls down on fastener 90 and cap 80. FIG. 11 shows rail 10 lifted out of channel 60 and ready to be moved to the collapsed position. Note that as rail 10 is raised, it lifts caps 80 which in turn raise fasteners 90 and nuts 94, thereby compressing biasing means 100 between nuts 94 and undersides 61A of channels 60. Once in this position, rail 10 can be rotated as shown in FIG. 12. Once rail 10 has been rotated such that it is positioned above channel 70, rail 10 can be lowered and is now in a collapsed or stored position adjacent wall W. Note that in this position biasing means 100 biases rail 10 into channel 70.

Although the present invention has been shown and described in detail, the same is for purposes of providing examples only and is not intended to limit the scope of the invention. Various changes and modifications can be made to the embodiments described without departing from the spirit of the invention. Accordingly, the scope of the invention is to be limited only by the terms of the attached claims.

We claim:

1. A handrail and bracket assembly, including:

a rail; and a bracket including:

a base;

a first wall extending from the base, the first wall defining a first plane;

a second wall extending from the base, the second wall being parallel to the first wall, the second wall defining a second plane;

at least one mounting hole located in the base, between the first and second walls, the mounting hole being located nearer the first wall than it is to the second wall;

a first channel for retaining the rail in a first position, the first channel having a central, longitudinal axis located between the first and second planes and nearer the second plane than it is to the first plane and an opening in the first channel;

a second channel for retaining the rail in a second position, the second channel having a central, longitudinal axis perpendicular to the central, longitudinal axis of the first channel; and a fastener for securing the rail to the bracket;

wherein the opening in the first channel receives the fastener.

2. The assembly according to claim 1, wherein the opening is located along the central, longitudinal axis of the first channel.

* * * * *